US008474534B1

(12) United States Patent
Fripp et al.

(10) Patent No.: US 8,474,534 B1
(45) Date of Patent: Jul. 2, 2013

(54) FUNCTIONALIZED SURFACE FOR FLOW CONTROL DEVICE

(75) Inventors: Michael Linley Fripp, Carrollton, TX (US); Michael T. Pelletier, Houston, TX (US); Jason D. Dykstra, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/642,913

(22) PCT Filed: Dec. 21, 2011

(86) PCT No.: PCT/US2011/066410

§ 371 (c)(1),
(2), (4) Date: Oct. 23, 2012

(51) Int. Cl.
*E21B 34/06* (2006.01)
*E21B 34/08* (2006.01)

(52) U.S. Cl.
CPC ..... *E21B 34/08* (2013.01)
USPC ..... 166/319; 166/284

(58) Field of Classification Search
USPC ..... 166/319, 284
See application file for complete search history.

(56) References Cited

U.S. PATENT DOCUMENTS

| | | | | |
|---|---|---|---|---|
| 7,462,274 | B2 | 12/2008 | Hamid et al. | |
| 2006/0027925 | A1 * | 2/2006 | Huang et al. | 257/751 |
| 2009/0055487 | A1 * | 2/2009 | Moraes et al. | 709/206 |
| 2009/0127179 | A1 | 5/2009 | Hamid et al. | |
| 2009/0133869 | A1 | 5/2009 | Clem | |

FOREIGN PATENT DOCUMENTS

| | | |
|---|---|---|
| WO | 2010053378 | 5/2010 |
| WO | 2010087719 | 8/2010 |
| WO | 2011095512 | 8/2011 |
| WO | 2011097101 | 8/2011 |
| WO | 2011115494 | 9/2011 |

OTHER PUBLICATIONS

International Application No. PCT/US2011/066410 , "International Search Report and Written Opinion" mailed Sep. 25, 2012 (12 pages).

* cited by examiner

*Primary Examiner* — Cathleen Hutchins
(74) *Attorney, Agent, or Firm* — Kilpatrick Townsend & Stockton LLP

(57) ABSTRACT

Flow control devices can include functionalized surfaces on inner regions of walls. A functionalized surface can include a hydrophilic and/or a hydrophobic material that can affect fluid flowing in a flow path of a wall to facilitate fluid selection by the flow control device. Fluids may be switched in a flow control device using a functionalized surface even when a density and viscosity of different oil and water mixtures of the fluids are the same.

17 Claims, 6 Drawing Sheets

FUNCTIONALIZED SURFACE FOR FLOW CONTROL DEVICE

CROSS-REFERENCE TO RELATED APPLICATIONS

This application is a U.S. national phase patent application under 35 U.S.C. 371 of International Patent Application No. PCT/US2011/066410 entitled "Functionalized Surface for Flow Control Device," filed Dec. 21, 2011, the application of which is incorporated herein by reference in its entirety.

TECHNICAL FIELD OF THE INVENTION

The present invention relates generally to flow control devices having a functionalized material on a surface configured to affect fluid flow in a bore in a subterranean formation in and, more particularly (although not necessarily exclusively), to hydrophilic and/or hydrophobic materials in a flow control device that can affect fluid flow.

BACKGROUND

Various devices can be installed in a well traversing a hydrocarbon-bearing subterranean formation. Some devices control the flow rate of fluid between the formation and tubing, such as production or injection tubing. An example of these devices is an autonomous valve that can select fluid, or otherwise control the flow rate of various fluids into the tubing.

An autonomous valve can select between desired and undesired fluids based on relative viscosity of the fluids. For example, fluid having a higher concentration of undesired fluids (e.g. water and natural gas) may have a certain viscosity in response to which the autonomous valve directs the undesired fluid in a direction to restrict the flow rate of the undesired fluid into tubing. The autonomous valve may include a switching mechanism that is, for example, in a flow ratio control device and may include a vortex assembly usable to select fluid based on viscosity. The flow ratio control assembly can include two passageways. Each passageway can include narrowed tubes that are configured to restrict fluid flow based on viscosity of the fluid. For example, one tube in the first passageway may be narrower than the second tube in the second passageway, and configured to restrict fluid having a certain relative viscosity more than fluid having a different relative viscosity. The second tube may offer relatively constant resistance to fluid, regardless of the viscosity of the fluid.

Fluid entering the vortex assembly via a first passageway, such as a passageway that is tangential to the vortex assembly, may be caused to rotate in the vortex assembly and restricted from exiting an exit opening in the vortex assembly. Fluid entering the vortex assembly via a second passageway, such as a passageway that is radial to the vortex assembly, may be allowed to exit through the exit opening without any, or much, restriction.

Although this autonomous valve is very effective in meeting desired fluid selection downhole, devices that can facilitate greater fluid switching are desirable.

SUMMARY

Certain aspects and embodiments of the present invention are directed to at least one material on an inner region of a wall. The material may facilitate directing fluid flow through the flow path to, for example, a switching mechanism of a flow control device.

One aspect relates to an assembly that can be positioned in a wellbore. The assembly includes a hydrophobic material and a hydrophilic material. The hydrophobic material is on a first portion of an inner region of a wall. The hydrophilic material is on a second portion of the inner region of the wall.

Another aspect relates to a flow control device that can be positioned in a wellbore. The flow control device includes an inner region of a wall and a switching mechanism. The inner region of the wall includes a portion that has a hydrophilic material on it. The switching mechanism is subsequent to the portion in a flow path of the flow control device.

Another aspect relates to a flow control device that can be positioned in a wellbore. The flow control device includes an inner region of a wall and a switching mechanism. The inner region of the wall includes a portion that has a hydrophobic material on it. The switching mechanism is subsequent to the portion in a flow path of the flow control device.

These illustrative aspects are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
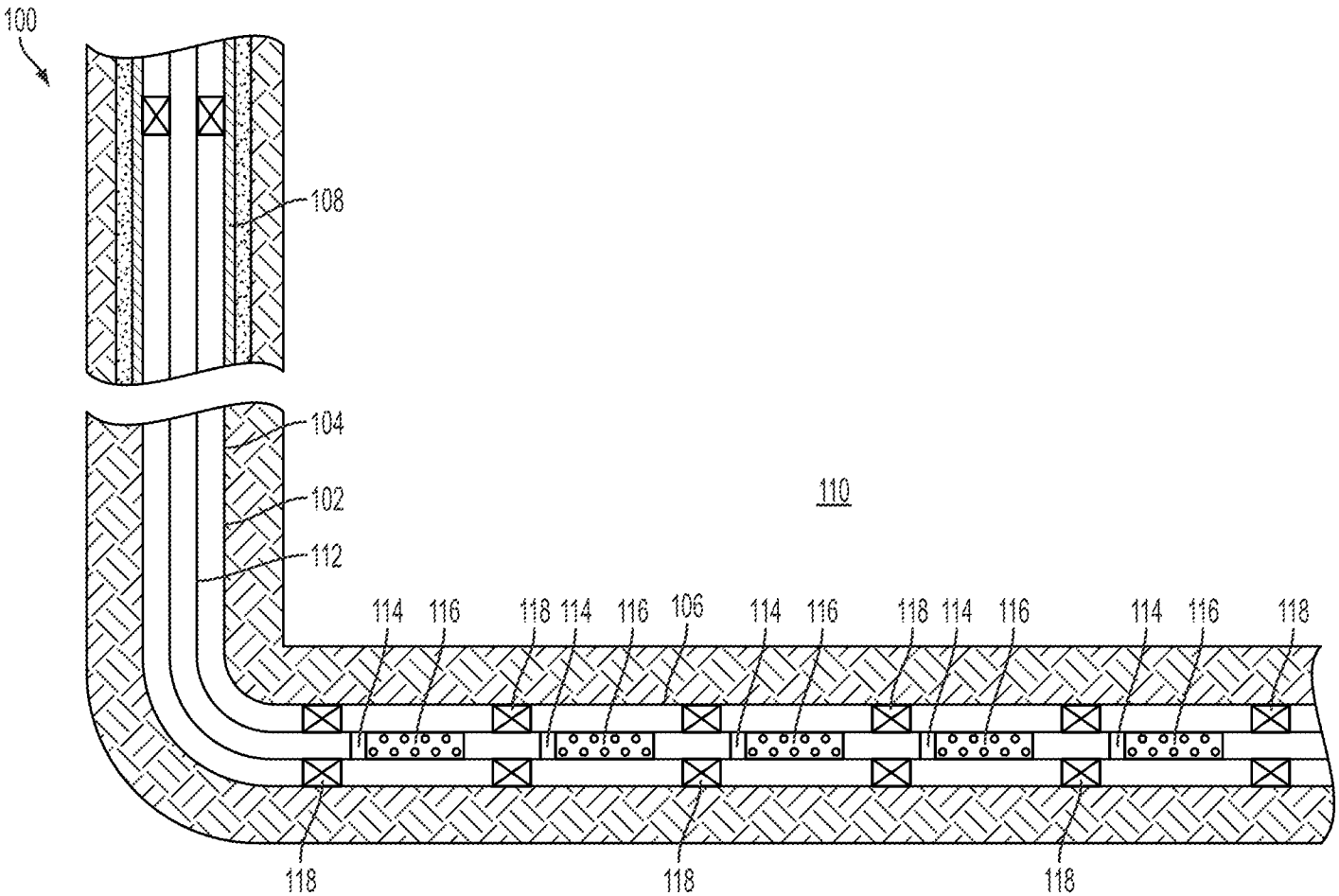
FIG. 1 is a schematic illustration of a well system having flow control devices that can include a functionalized surface according to one embodiment of the present invention.

Certain aspects and embodiments relate to a functionalized surface of an inner region of a wall. The surface can be functionalized using at least one of a hydrophobic material or a hydrophilic material on a portion of the surface. The functionalized surface can facilitate directing fluid flow through the flow path to, for example, a switching mechanism of a flow control device. For example, fluids may be switched in an assembly using the functionalized surface even when a density and viscosity of different oil and water mixtures of the fluids are the same.

Hydrophobic material may be a material that repeals fluid having a high concentration of water. Hydrophilic material may be a material that can bond with fluid having a high concentration of water, such that the effect may be that the material attracts fluid having a high concentration of water. In some embodiments, hydrophobic material may attract fluid having a high concentration of oil or other hydrocarbon, and hydrophilic material may repeal fluid having a high concentration of oil or other hydrocarbon.

Examples of hydrophilic material include aluminum oxide, silica compounds such as silicon oxide, nylon, and smooth Teflon®. Examples of hydrophobic material include nylon with alcohol, textured Teflon®, silicone oils, metal surfaces (which may be metal surfaces other than metal oxides), and textured metal surfaces. Hydrophobic material in some embodiments may be created by imbedding polar compounds or asphaltenes into a structural matrix in an inner wall of an assembly. For example, surfaces that include sulfur, graphite, and coal may become a hydrophobic material.

In some embodiments, a wall can include a hydrophilic material on one side of the wall and a hydrophobic material on an opposite side of the wall. Fluid having a higher concentration of water may flow through a flow path by the materials. The presence of at least one of the material may change a velocity profile of the fluid. For example, the fluid may be attracted to the side that includes the hydrophilic material such that fluid flows with a higher velocity on the opposite side of the wall. A switching mechanism subsequent to the material in the flow path can use the change in velocity profile to guide more fluid to one passageway over another in a flow control device.

In other embodiments, hydrophobic material and hydrophilic material can be patterned, such as alternating adjacent portions with hydrophobic and hydrophilic material, on an inner region of a wall. The patterned material may affect a velocity profile, or otherwise affect flow, of fluid flowing by the patterned material, depending on a property of the fluid. The property may include the relative concentration of water or other type of fluid in the fluid flow.

Material according to some embodiments may be in an inner region of a wall that can respond to stimuli that is provided while the material is in the wellbore to change, permanently or temporarily, to a hydrophobic material and/or a hydrophilic material. For example, certain material may be located in the wall in a wellbore that, when exposed to a light of a certain frequency or color, can change to a hydrophilic material for a definite length of time. Material may respond to other stimuli, such as electric energy or voltage, and chemicals introduced into the flow path. Examples of material that may respond to stimuli to change to a hydrophilic material include functionalized spiropyrans ferro fluids and functionalized quinones. Examples of material that may respond to stimuli to change to a hydrophobic material include azobenzenes and functionalized azobenzens (thiol terminated). Examples of additional materials that may respond to stimuli to change to a hydrophilic and/or hydrophobic material include self-assembled monolayers, shape-memory polymers, rotaxane, catenane, DNA monolayers, and peptide monolayers.

These illustrative examples are given to introduce the reader to the general subject matter discussed here and are not intended to limit the scope of the disclosed concepts. The following sections describe various additional embodiments and examples with reference to the drawings in which like numerals indicate like elements, and directional descriptions are used to describe the illustrative embodiments but, like the illustrative embodiments, should not be used to limit the present invention.

FIG. 1 depicts a well system 100 with chambers having flow control devices according to certain embodiments of the present invention that include hydrophobic and/or hydrophilic material in inner regions of walls. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

A tubing string 112 extends from the surface within wellbore 102. The tubing string 112 can provide a conduit for formation fluids to travel from the substantially horizontal section 106 to the surface. Flow control devices 114 and production tubular sections 116 in various production intervals adjacent to the formation 110 are positioned in the tubing string 112.

On each side of each production tubular section 116 is a packer 118 that can provide a fluid seal between the tubing string 112 and the wall of the wellbore 102. Each pair of adjacent packers 118 can define a production interval.

Each of the production tubular sections 116 can provide sand control capability. Sand control screen elements or filter media associated with production tubular sections 116 can allow fluids to flow through the elements or filter media, but prevent particulate matter of sufficient size from flowing through the elements or filter media. In some embodiments, a sand control screen may be provided that includes a non-perforated base pipe having a wire wrapped around ribs positioned circumferentially around the base pipe. A protective outer shroud that includes perforations can be positioned around an exterior of a filter medium.

Flow control devices 114 can allow for control over the volume and composition of produced fluids. For example, flow control devices 114 may autonomously restrict or resist production of formation fluid from a production interval in which undesired fluid, such as water or natural gas for an oil production operation, is entering. "Natural gas" as used herein means a mixture of hydrocarbons (and varying quantities of non-hydrocarbons) that exists in a gaseous phase at room temperature and pressure and in a liquid phase and/or gaseous phase in a downhole environment.

Formation fluid flowing into a production tubular section 116 may include more than one type of fluid, such as natural gas, oil, water, steam and carbon dioxide. Steam and carbon dioxide may be used as injection fluids to cause hydrocarbon fluid to flow toward a production tubular section 116. Natural gas, oil and water may be found in the formation 110. The proportion of these types of fluids flowing into a production tubular section 116 can vary over time and be based at least in part on conditions within the formation and the wellbore 102. A flow control device 114 according to some embodiments can reduce or restrict production from an interval in which fluid having a higher proportion of undesired fluids.

When a production interval produces a greater proportion of undesired fluids, a flow control device 114 in that interval can restrict or resist production from that interval. Other production intervals producing a greater proportion of desired fluid, can contribute more to the production stream entering tubing string 112. For example, the flow control device 114 can include hydrophobic and/or hydrophilic material in a wall that can facilitate the flow control device 114 in selecting fluid based on one or more properties of the fluid.

Although FIG. 1 depicts flow control devices 114 positioned in the substantially horizontal section 106, flow control devices 114 (and production tubular sections 116) according to various embodiments of the present invention can be located, additionally or alternatively, in the substantially vertical section 104. Furthermore, any number of flow control devices 114, including one, can be used in the well system 100 generally or in each production interval. In some embodiments, flow control devices 114 can be positioned in simpler wellbores, such as wellbores having only a substantially vertical section. Flow control devices 114 can be positioned in open hole environments, such as is depicted in FIG. 1, or in cased wells.

Figure 2:
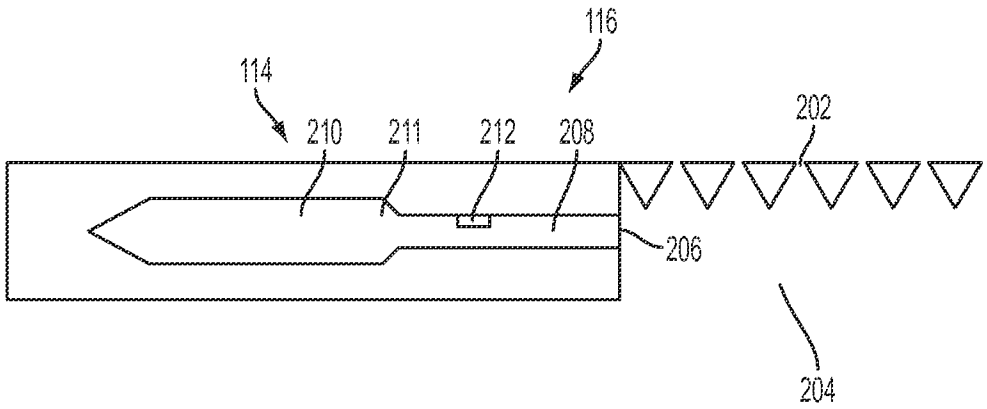
FIG. 2 is a cross-sectional side view of a screen and a flow control device with a functionalized surface that includes a hydrophilic or a hydrophobic material according to one embodiment of the present invention.

FIG. 2 depicts a cross-sectional side view of a production tubular section 116 that includes a flow control device 114 and a screen assembly 202. The production tubular defines an interior passageway 204, which may be an annular space. Formation fluid can enter the interior passageway 204 from the formation through screen assembly 202, which can filter the fluid. Formation fluid can enter the flow control device 114 from the interior passageway through an inlet 206 to a flow path 208 of a vortex assembly 210 that includes a switching mechanism 211. The flow control device 114 includes a material 212 on an inner region of a wall of the flow control device 114. The material 212 may be a hydrophobic or a hydrophilic material that can facilitate fluid selection by the switching mechanism 211.

Figure 3:
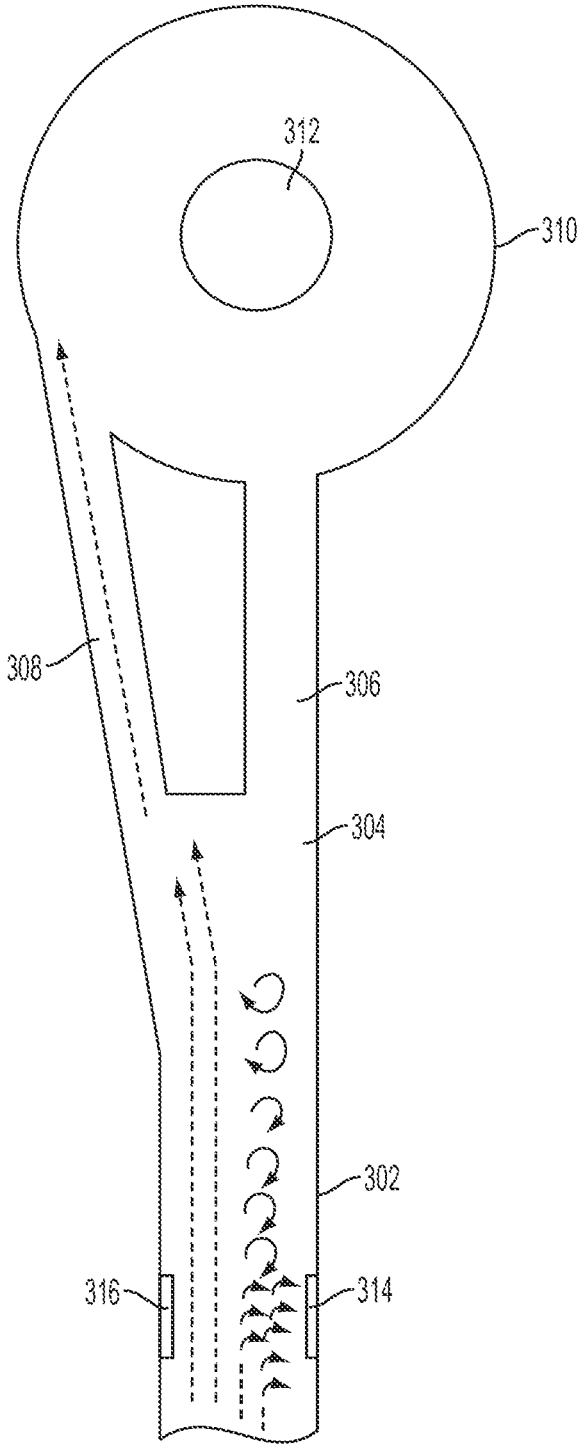
FIG. 3 is a cross-sectional top view of a flow control device that includes hydrophilic material and hydrophobic material, and fluid flow having a greater concentration of a first type of fluid according to one embodiment of the present invention.
Figure 4:
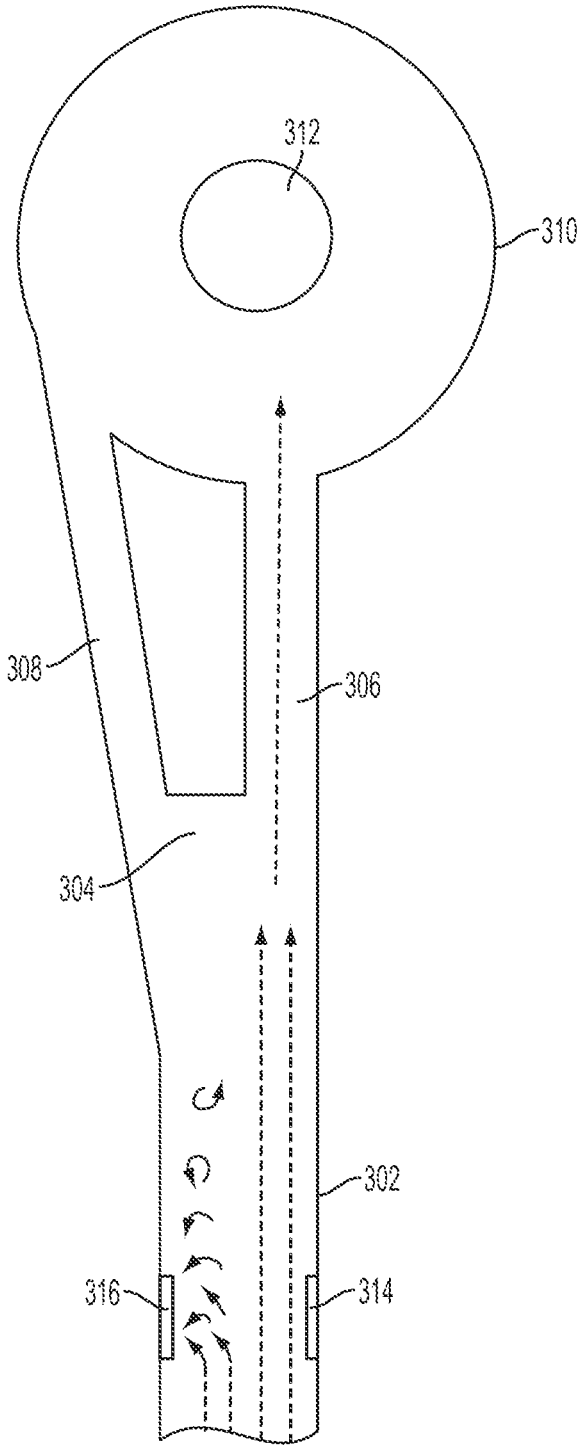
FIG. 4 shows the flow control device of FIG. 3 with fluid flow having a greater concentration of a second type of fluid according to one embodiment of the present invention.

FIGS. 3-4 show a flow control device according to one embodiment. The flow control device includes a wall 302 and a switching mechanism 304 providing a flow path to two passageways 306, 308 that allow fluid to flow to a vortex assembly 310 at a radial angle (passageway 306) or a tangential angle (passageway 308). Fluid flowing into the vortex assembly 310 via passageway 306 may be guided to an exit opening 312 in the vortex assembly 310. Fluid flowing into the vortex assembly 310 via passageway 308 may be guided into a vortex about the exit opening 312 and restricted, at least partially and for at least a certain amount of time, from exiting through the exit opening 312.

Although a vortex assembly is depicted in FIGS. 3-4, any fluid selection mechanism may be used.

On portions of the wall 302 are hydrophilic material 314 and hydrophobic material 316. Hydrophilic material 314 and hydrophobic material 316 may overlay the wall 302 or be embedded in the wall 302. FIGS. 3-4 depict hydrophilic material 314 on an opposite portion of the wall 302 from the hydrophobic material 316, but other configurations may be possible. For example, hydrophilic material 314 may be on the same side of the wall 302 as hydrophobic material 316. In other embodiments, hydrophilic material 314 is on an opposite side of the wall 302 from hydrophobic material 316, but not directly opposite from the hydrophobic material 316. In still other embodiments, one of the hydrophilic material 314 or the hydrophobic material 316 is used, but not both types of materials.

FIGS. 3-4 show via arrows fluid flowing in a flow path defined by the wall 302 and by the hydrophilic material 314 and hydrophobic material 316. In FIG. 3, the fluid may have a high concentration of water. Part of the fluid flowing proximate the hydrophilic material 314 may be attracted to the hydrophilic material 314, and in some cases may accumulate on the hydrophilic material 314. Accumulating fluid on the hydrophilic material 314, or otherwise the attraction of fluid toward the hydrophilic material 314, may change the effective surface roughness of the wall 302 to cause a change in a velocity profile to at least part of the fluid flowing in the flow path. The change in velocity may be used by the switching mechanism 304 to select more fluid to flow through one of the passageways 306, 308 than the other passageway. In some embodiments, the change in velocity profile may result in fluid oscillate and in an increase differential pressure for the fluid during flow through the flow path to the switching mechanism.

For example, and as shown in FIG. 3, part of the fluid flowing through the flow path closer to the hydrophobic material 316 than the hydrophilic material 314 may flow at a higher velocity such that more of the fluid flows through passageway 308 than passageway 306. Although not depicted in FIG. 3, some fluid may flow through passageway 306, but at lesser amount than through passageway 308.

In FIG. 4, the fluid may have a higher concentration of oil or other type of hydrocarbon. Part of the fluid flowing proximate the hydrophobic material 316 may be attracted to the hydrophobic material 316, and in some cases may accumulate on the hydrophobic material 316 and change the effective surface roughness of the wall 302 to cause a change in a velocity profile to at least part of the fluid flowing in the flow path. The change in velocity may be used by the switching mechanism 304 to select more fluid to flow through one of the passageways 306, 308 than the other passageway. For example, and as shown in FIG. 4, part of the fluid flowing through the flow path closer to the hydrophilic material 314 than the hydrophobic material 316 may flow at a higher velocity such that more of the fluid flows through passageway 306 than passageway 308.

Although FIGS. 3-4 depict hydrophilic material 314 on a side of the wall 302 corresponding to a radial passageway 306 and hydrophobic material 316 on a side of the wall corresponding to a tangential passageway 308, other and opposite configurations are possible.

Figure 5:
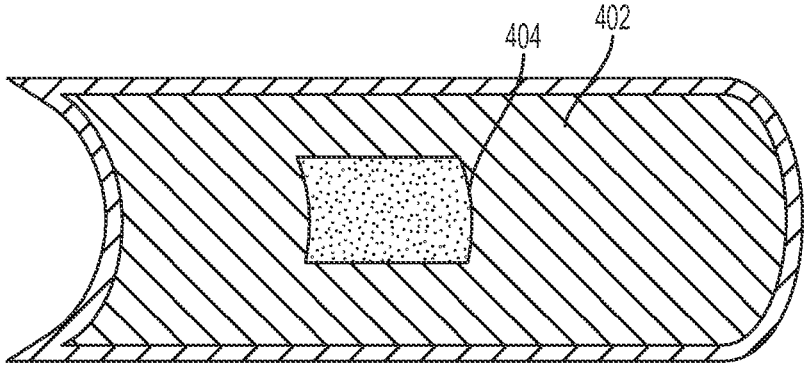
FIG. 5 is a cross-sectional side view of a wall having a hydrophobic material or hydrophilic material on the wall according to one embodiment of the present invention.

FIG. 5 depicts a cross-section of a portion of a wall 402 that includes a material 404 on an inner region of the wall 402. The inner region of the wall 402 may be any shape, including rectangular. The material 404 may be hydrophilic material, hydrophobic material, or a material capable of being hydrophobic and/or hydrophilic material in response to stimuli. The material 404 may be sized to provide desired performance in affecting a velocity profile of fluid flowing through a flow path in the wall 402. In some embodiments, material 404 is on an entire circumferential portion of the inner region of the wall 402.

Material 404 may be screen-printed or otherwise overlaid on the inner region of the wall 402. In some embodiments, material 404 is bonded to the inner region of the wall 402 via an adhesive or mechanical coupler. In other embodiments, material 404 may be embedded in the wall 402. For example, part of the inner region of the wall 402 can be removed and material 404 can be coupled to the wall 402 in place of the removed portion. Embedding material 404 in the wall 402 may avoid material 404 extending into the flow path in the wall 402.

Figure 6:
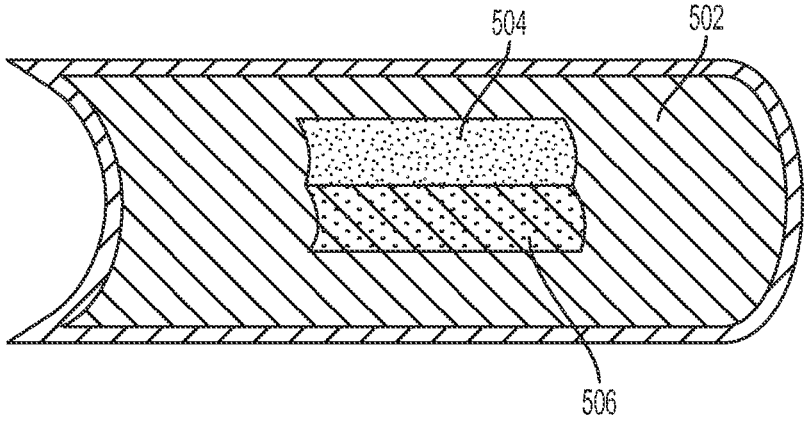
FIG. 6 is a cross-sectional side view of a wall having a hydrophobic material and a hydrophilic material on the wall in a pattern according to one embodiment of the present invention.

In other embodiments, material may be included in an inner region of a wall in a pattern. FIG. 6 depicts a cross-section of part of a wall 502 that includes hydrophilic material 504 and hydrophobic material 506 in a pattern. The pattern can include hydrophilic material 504 adjacent to the hydrophobic material 506. More complex patterns than is shown in FIG. 6 can be used. For example, hydrophobic material and hydrophilic material may be alternately positioned adjacent to each other.

Figure 7:
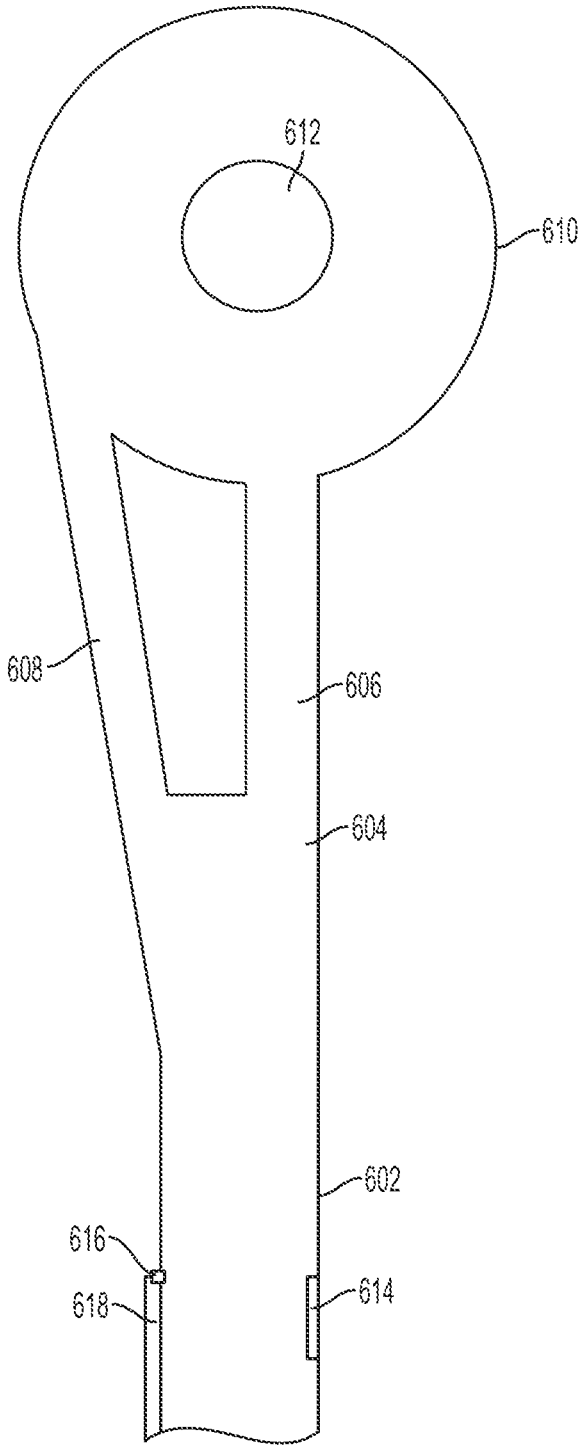
FIG. 7 is a cross-sectional top view of a flow control device with material on a wall that can respond to stimuli provided to the material according to one embodiment of the present invention.

FIG. 7 shows a flow control device according to another embodiment. Similar to the embodiment in FIGS. 3-4, the flow control device includes a wall 602 and a switching mechanism 604 providing a flow path to two passageways 606, 608 that allow fluid to flow to a vortex assembly 610 at a radial angle (passageway 606) or a tangential angle (passageway 608). Fluid flowing into the vortex assembly 610 via passageway 606 may be guided to an exit opening 612 in the vortex assembly 610. Fluid flowing into the vortex assembly 610 via passageway 608 may be guided into a vortex about the exit opening 612 and restricted, at least partially and for at least a certain amount of time, from exiting through the exit opening 612.

The flow control device includes material 614 on a portion of an inner region of wall 602 that is antecedent to the switching mechanism 604. The material 614 may be capable of responding to stimuli by changing to a hydrophilic material and/or a hydrophobic material. A stimuli source 616 is positioned on an opposite side of the wall 602 to the material 614. A control line 618 is coupled to the stimuli source 616. The control line 618 may provide communication to a surface of a wellbore, or the control line 618 may be coupled to another component capable of providing control signals to the stimuli source 616.

The stimuli source 616 in FIG. 7 may be a light source capable of providing light at a certain frequency to cause material 614 to change to a hydrophilic or hydrophobic material. The light source can be controlled via control line 618. The light source can be powered via a local power source (e.g. a battery or power generator) or via power delivered over control line 618. A signal can be carried to the light source to cause the light source to emit light at a selected frequency (e.g. red or blue). In response to being exposed to the light, the material 614 can change to a hydrophobic material or a hydrophilic material, as may be configured, and affect fluid flowing through a flow path of the wall 602. The material 614 may be configured to remain as a hydrophobic material or a hydrophilic material for a certain amount of time after being exposed to the light, until the light source exposes the material 614 to light having a different frequency, or permanently.

In other embodiments, the light source is positioned on the same side of the wall 602 as the material 614. For example, the light source may be embedded in the wall 602, but behind the material 614.

Stimuli sources according to other embodiments may provide stimuli that is different than light. For example, a stimuli source may controllably provide stimuli that include voltage or a chemical to material. The material may be configured to respond to a certain chemical or electric energy, such as a certain voltage, to change to a hydrophobic material or a hydrophilic material.

Stimuli sources according to some embodiments may also measure fluid that may accumulate on the stimuli sources. Based on properties measured from the fluid, a stimuli source may output a certain stimuli to cause material to change to a hydrophobic material or a hydrophilic material.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. An assembly capable of being positioned in a wellbore, the assembly comprising:

a hydrophobic material on a first portion of an inner region of a wall; and a hydrophilic material on a second portion of the inner region of the wall, wherein the first portion is on an opposite side of the inner region of the wall to the second portion.

2. The assembly of claim 1, wherein the wall is adapted to be positioned antecedent in a flow path to a switching mechanism for a flow control device.

3. The assembly of claim 2, wherein at least one of the hydrophobic material or the hydrophilic material is adapted to increase surface roughness of part of the inner region of the wall based on at least one property of fluid flowing through the flow path.

4. The assembly of claim 2, wherein at least one of the hydrophobic material or the hydrophilic material is adapted to cause fluid flowing through the flow path to oscillate, resulting in an increase differential pressure for the fluid during flow through the flow path to the switching mechanism.

5. The assembly of claim 4, wherein at least one of the hydrophobic material or the hydrophilic material is adapted to cause fluid flowing through the flow path to oscillate by changing a velocity profile of the fluid flowing through the flow path.

6. The assembly of claim 2, wherein the switching mechanism is adapted to be positioned between a vortex assembly and the first portion and the second portion of the inner region of the wall, the switching mechanism comprising a plurality of passageways that provide separate flow paths to the vortex assembly.

7. The assembly of claim 1, wherein at least one of:

first material on the first portion of the inner region of the wall is configured to change to the hydrophobic material in response to stimuli applied to the first material in the wellbore; or second material on the second portion of the inner region of the wall is configured to change to the hydrophilic material in response to the stimuli applied to the second material in the wellbore.

8. The assembly of claim 7, wherein the stimuli comprises one of:

light;

electric energy; or a chemical.

9. The assembly of claim 1, wherein the first portion and the second portion are in a pattern on the inner region of the wall.

10. A flow control device adapted to be positioned in a wellbore, the flow control device comprising:

an inner region of a wall comprising a portion having a hydrophilic material thereon; and a switching mechanism subsequent to the portion in a flow path of the flow control device, wherein the inner region of the wall further comprises a second portion having a hydrophobic material thereon.

11. The flow control device of claim 10, wherein the portion and the second portion are in a pattern on the inner region of the wall.

12. The flow control device of claim 10, wherein the portion is on an opposite side of the inner region of the wall to the second portion.

13. The flow control device of claim 10, wherein the hydrophilic material is adapted to increase surface roughness of part of the inner region of the wall in response to fluid having a higher concentration of water than other types of fluid.

14. The flow control device of claim 13, wherein the part of the inner region of the wall having the increase surface roughness is configured to change a velocity profile of the fluid having the higher concentration of water than other types of fluid, wherein the switching mechanism is configured to cause the fluid to be selected using the change to the velocity profile of the fluid.

15. The flow control device of claim 10, wherein the hydrophilic material comprises a material that changes to the hydrophilic material in response to stimuli applied to the material in the wellbore, wherein the stimuli comprises one of:

light;

electric energy; or a chemical.

16. A flow control device adapted to be positioned in a wellbore, the flow control device comprising:

an inner region of a wall comprising a portion having a hydrophobic material thereon; and a switching mechanism subsequent to the portion in a flow path of the flow control device, wherein the inner region of the wall further comprises a second portion having a hydrophilic material thereon.

17. The flow control device of claim 16, wherein the hydrophobic material is adapted to increase surface roughness of part of the inner region of the wall in response to fluid having a higher concentration of hydrocarbons than other types of fluid.

* * * * *